US006471106B1

(12) United States Patent
Reining

(10) Patent No.: US 6,471,106 B1
(45) Date of Patent: Oct. 29, 2002

(54) APPARATUS AND METHOD FOR RESTRICTING THE DISCHARGE OF FASTENERS FROM A TOOL

(75) Inventor: William N. Reining, Cross Plains, WI (US)

(73) Assignee: Intellectual Property LLC, Cross Plains, WI (US)

( * ) Notice: Subject to any disclaimer, the term of this patent is extended or adjusted under 35 U.S.C. 154(b) by 0 days.

(21) Appl. No.: 09/998,937

(22) Filed: Nov. 15, 2001

(51) Int. Cl.[7] ..... B25C 1/04

(52) U.S. Cl. ..... 227/8; 227/2; 227/156; 324/207.16; 324/248; 324/439; 324/637

(58) Field of Search ..... 227/2, 8, 131, 227/156; 324/633, 637, 648, 207.16, 207.24, 445, 441, 439, 248

(56) References Cited

U.S. PATENT DOCUMENTS

| | | | | |
|---|---|---|---|---|
| 2,542,057 A | | 2/1951 | Relis | |
| 3,609,580 A | | 9/1971 | Thompson et al. | |
| 3,806,798 A | | 4/1974 | Gross | |
| 3,855,522 A | | 12/1974 | Kobayashi | |
| 3,867,688 A | | 2/1975 | Koski | |
| 3,891,916 A | | 6/1975 | Meador et al. | |
| 3,980,076 A | | 9/1976 | Wikswo, Jr. et al. | |
| 3,989,009 A | | 11/1976 | Robar et al. | |
| 4,146,834 A | | 3/1979 | Maltby et al. | |
| 4,220,920 A | | 9/1980 | Gross | |
| 4,258,718 A | | 3/1981 | Goldman | |
| 4,279,257 A | | 7/1981 | Hochstein | |
| 4,308,872 A | | 1/1982 | Watson et al. | |
| 4,324,255 A | | 4/1982 | Barach et al. | |
| 4,348,984 A | | 9/1982 | Brayer | |
| 4,446,427 A | | 5/1984 | Lovrenich | |
| 4,494,553 A | | 1/1985 | Sciarra et al. | |
| 4,536,713 A | | 8/1985 | Davis et al. | |
| 4,740,755 A | | 4/1988 | Ogawa | |
| 4,825,168 A | | 4/1989 | Ogawa et al. | |
| 4,919,640 A | | 4/1990 | Yanagibori | |
| 5,077,525 A | | 12/1991 | West et al. | |
| 5,131,399 A | | 7/1992 | Sciarra | |
| 5,157,332 A | | 10/1992 | Reese | |
| 5,237,606 A | | 8/1993 | Ziermann | |
| 5,291,782 A | | 3/1994 | Taylor | |
| 5,331,968 A | | 7/1994 | Williams et al. | |
| 5,339,037 A | | 8/1994 | Bonner et al. | |
| 5,610,560 A | | 3/1997 | Sauer et al. | |
| 5,666,710 A | * | 9/1997 | Weber et al. | 227/2 |
| 5,680,201 A | | 10/1997 | Veronesi | |
| 5,686,841 A | | 11/1997 | Stolarczyk et al. | |
| 5,687,899 A | * | 11/1997 | Dohi et al. | 227/8 |
| 5,772,096 A | * | 6/1998 | Osuka et al. | 227/8 |
| 6,062,454 A | * | 5/2000 | Morishige et al. | 227/2 |
| 6,126,651 A | * | 10/2000 | Mayer | 227/2 |

FOREIGN PATENT DOCUMENTS

| | | |
|---|---|---|
| DE | 22 10 296 A | 9/1973 |
| DE | 35 32 520 A | 3/1987 |
| GB | 2 012 431 A | 9/1983 |
| GB | 2 116 725 A | 9/1983 |

* cited by examiner

*Primary Examiner*—Scott A. Smith
(74) *Attorney, Agent, or Firm*—Quarles & Brady LLP

(57) ABSTRACT

A device for discharging fastening elements, and a method of preventing a device from discharging fastening devices into human flesh, are disclosed. The device includes a coil proximate a location of discharge, a capacitive element coupled in parallel with the conductive coil to form a resonant tank circuit, an oscillator that drives the tank circuit, a frequency detector, an amplitude control circuit and a processor. The detector detects a frequency of oscillation of the tank circuit as affected by a material proximate the coil. In response to an electrical signal from the oscillator, the control circuit generates a control signal that is provided back to the oscillator. Based upon the frequency and an additional signal functionally related to the control signal, the processor provides an output signal that prevents the device from discharging when the material proximate the coil is human flesh.

20 Claims, 2 Drawing Sheets

FIG. 3
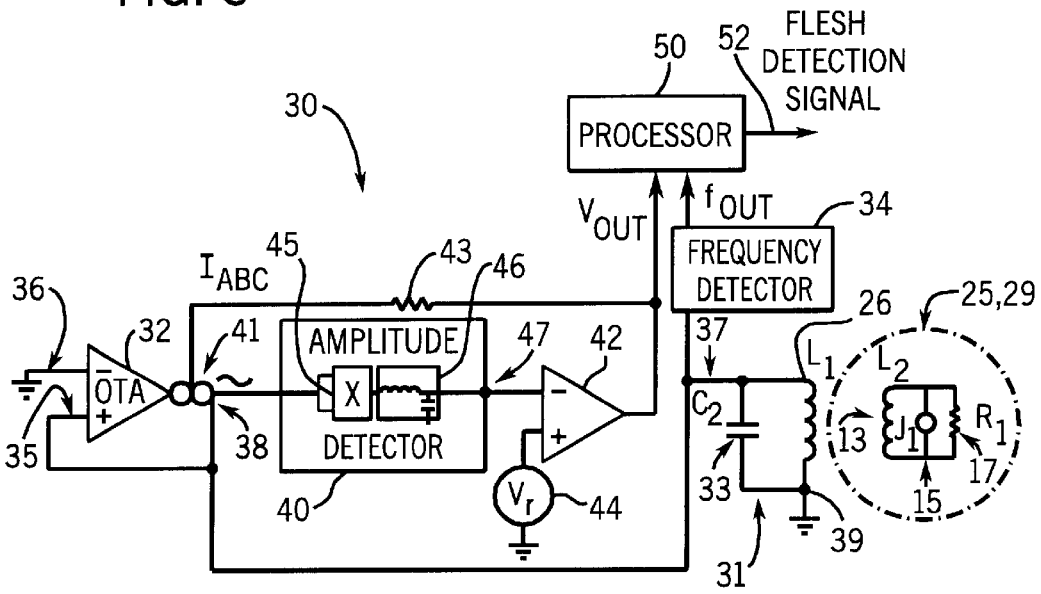
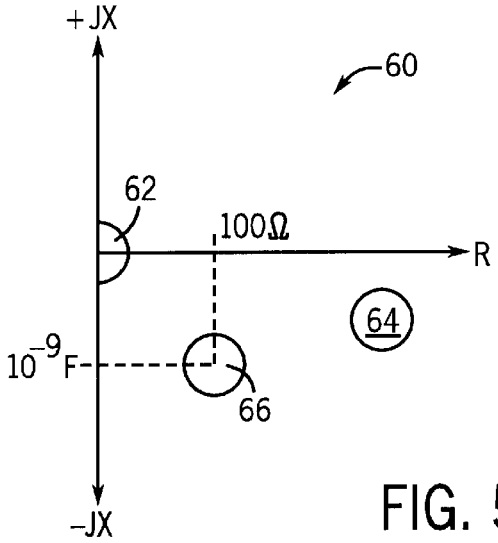
FIG. 5

APPARATUS AND METHOD FOR RESTRICTING THE DISCHARGE OF FASTENERS FROM A TOOL

FIELD OF THE INVENTION

The present invention relates to nail guns and similar construction, manufacturing or assembly devices, and more particularly relates to an apparatus and method for restricting operation of such devices under certain operational circumstances.

BACKGROUND OF THE INVENTION

A variety of construction, manufacturing, or assembly tools operate by discharging fastening devices towards a target material. Such tools include, for example, nail guns and staplers. Typically, the fastening devices that are discharged from these tools are projected at high velocities, so that the fastening devices effectively penetrate, and become secured with respect to, the target material.

Often these tools must be used at a rapid pace by construction workers and other operators. To facilitate such rapid use, the tools often include mechanisms that reduce the amount of effort that the operator must put forth in order to cause the tools to discharge the fastening devices. For example, nail guns often include pressure sensing devices near the tips of their barrels so that the nail guns discharge fasteners immediately once the nail guns are pressed onto the target material, without any additional triggering action on the part of the operator.

Due to the rapid pace at which the tools are used, combined with possible fatigue of the operators, or even due to carelessness on the part of the operators, the tools can be misdirected toward the operators themselves or toward other human beings.

To avoid the discharge of fastening devices when the tools are so misdirected, it would be advantageous for the tools to have a feature that allowed the tools to automatically determine whether the tools were being misdirected and, while determining this to be the case, rendered the tools disabled from discharging fastening devices. It would further be advantageous if such a feature in the tools did not significantly restrict the pace at which the tools could be used in construction, manufacturing, or assembly.

SUMMARY OF THE INVENTION

The present inventor has realized that a coil can be placed on the tip of a nail gun or similar device and be employed as part of a sensor to determine whether the tip of the nail gun is abutting human flesh as opposed to a standard target material such as wood or metal. The coil forms part of a resonant tank circuit of the sensor, and produces a magnetic field that causes eddy currents to occur within the abutting material in accordance with Lenz's law. The eddy currents in turn can produce a change in the quality factor of the tank circuit, and the inductive or capacitive nature of the material will cause a change in the resonant frequency of the tank circuit. The sensor is able to determine a resistance of the abutting material based upon the change in the quality factor and a reactance of the abutting material based upon the change in the resonant frequency. By comparing the measured resistance and reactance values with known values associated with different materials, the sensor is able to generate a signal indicating when the abutting material is human flesh or some other non-construction material, such that the nail gun should be disabled and allowed to fire only upon an operation override.

In particular, the present invention relates to a device for discharging fastening elements. The device includes a body having a location at which the fastening elements are discharged, and a sensor circuit supported by the body. The sensor circuit includes a conductive coil proximate the location and further includes a capacitive element, a frequency detector, an oscillator, an amplitude control circuit and a processor. The capacitive element is connected in parallel with the conductive coil so that the capacitive element and the conductive coil form a resonant tank circuit. The frequency detector is connected to the resonant tank circuit, detects a frequency of oscillation of the resonant tank circuit as affected by a material proximate the conductive coil and outputs a frequency signal indicative thereof. The oscillator has an output terminal and a control terminal, where the output terminal is connected to the resonant tank circuit, and where the oscillator drives the resonant tank circuit at the resonant frequency of the resonant tank circuit as affected by the material proximate the conductive coil. The amplitude control circuit is coupled to the oscillator, receives an electrical signal from the output terminal, and in response generates a control signal that is provided to the control terminal of the oscillator. The processor receives the frequency signal and an additional signal that is functionally related to the control signal. The processor provides an output signal that prevents the device from discharging at least one of the fastening elements when the processor determines that the frequency signal and the additional signal indicate that the material proximate the conductive coil is a particular material into which the fasteners should not be discharged.

The present invention additionally relates to a tool for discharging fastening devices. The tool includes means for discharging the fastening devices, and means for determining when the fastening devices are to be discharged, where the determining means is coupled to the discharging means. The tool additionally includes means for generating an oscillatory signal, where a resonant frequency of the oscillatory signal depends both upon characteristics of the generating means and also upon a material proximate at least one portion of the generating means, and where the generating means is supported by the discharging means. The tool further includes means for detecting a frequency of the oscillatory signal and producing a first signal indicative thereof, where the detecting means is electrically coupled to the generating means. The tool additionally includes means for producing a second signal indicative of a quality factor of the oscillatory signal, where the quality factor depends at least in part upon the material proximate the at least one portion of the generating means, and where the producing means is coupled to the generating means. The tool further includes means for providing a third signal to prevent the determining means from causing the discharging means to discharge at least one of the fastening devices, where the third signal is provided in response to the first and second signals.

The present invention additionally relates to a method of preventing a tool from discharging a fastening device into human flesh. The method includes exciting a resonant tank circuit having a coil with an electrical signal to produce an oscillatory signal within the resonant tank circuit and an electromagnetic field that envelops a material that is proximate the coil, where the electrical signal is continually adjusted to be at a resonant frequency of the resonant tank circuit as affected by the material. The method additionally includes generating a frequency signal indicative of a frequency of oscillation of the oscillatory signal, which is the resonant frequency of the resonant tank circuit as affected by the material. The method further includes generating a control signal for controlling an amplitude of the electrical signal so that the oscillatory signal tends toward a constant amplitude. The method additionally includes processing the frequency signal and an additional signal that is functionally related to the control signal to determine whether the material has a resistance and a reactance characteristic of human flesh. The method further includes, when the processing of the frequency signal and the additional signal indicates that the material has the resistance and the reactance characteristic of human flesh, producing an output signal that causes the tool to become disabled from discharging the fastening device.

BRIEF DESCRIPTION OF THE DRAWINGS

FIG. 3 is a schematic diagram of a sensor circuit including the coil in the tip of the nail gun of FIGS. 1 and 2, which is capable of detecting a resistance and a reactance of a material abutting the tip of the nail gun and generating a flesh detection signal in response thereto.

FIG. 5 is a graph of resistance versus reactance showing exemplary characteristic resistances and reactances associated with different materials including standard target materials and human flesh, which information can be employed by the sensor circuit of FIG. 4.

DETAILED DESCRIPTION OF THE PREFERRED EMBODIMENT

Figure 1:
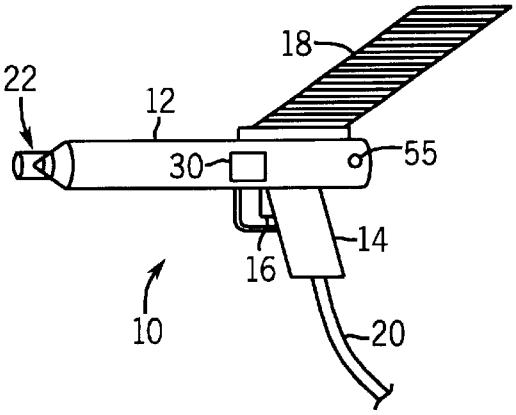
FIG. 1 is a perspective view of a nail gun having a coil on a tip of the nail gun in accordance with one embodiment of the present invention.

Referring to FIG. 1, a nail gun 10 is shown to include a barrel 12, a handle 14 and a trigger 16. The nail gun 10 is representative of a variety of different types of tools employed in construction, manufacturing or other assembly processes to affix fasteners to target materials including, for example, staplers. The nail gun 10, which can be held by an operator at handle 14, further includes (or is coupled to) a nail supply 18 and a power supply 20. The nail supply 18 is shown to be a cartridge full of nails, although in alternate embodiments other sources of nails can be employed. The power supply 20 is shown to be an electric power cord, although in alternate embodiments the power supply can be a battery, air pressure supply, or other source of power.

Figure 2:
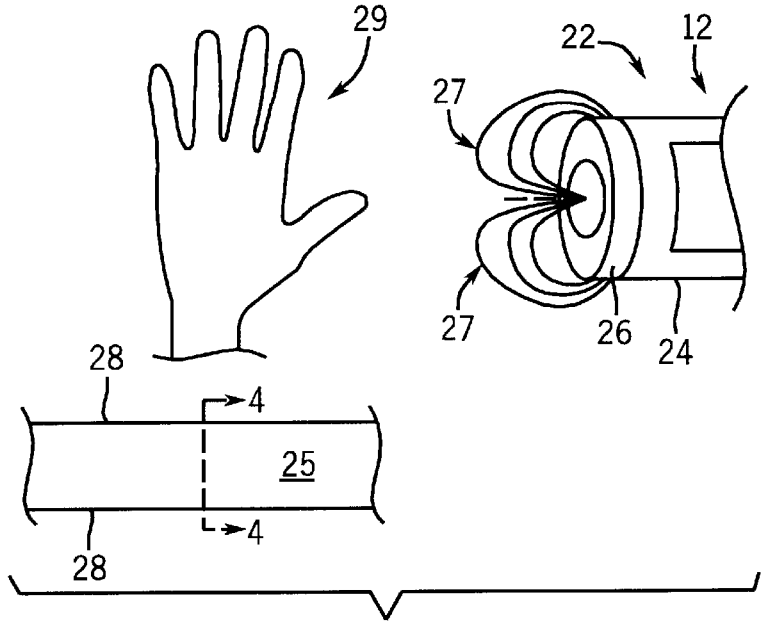
FIG. 2 is a perspective view of the tip of the nail gun of FIG. 1 including the coil, shown in cut-away, alongside an exemplary portion of the human body and an exemplary, standard target material.

Referring to FIGS. 1 and 2, the barrel 12 includes a tip 22 out of which the nail gun 10 discharges nails. At the tip 22 is a pressure sensor 24. Although an operator can manually fire the nail gun 10 by pressing the trigger 16, the nail gun is designed to allow automatic triggering by way of the pressure sensor 24. That is, when the tip 22 of the nail gun 10 is pressed against a standard target material such as a wooden beam 25, the pressure sensor 24 detects the pressure on the tip 22 and produces a signal that automatically triggers the nail gun to discharge a nail. The standard target material can be, instead of the wooden beam 25, any of a number of different materials such as metal, plaster, or concrete.

In accordance with one embodiment of the present invention, also at the tip 22 is a wire coil 26 that can be made from standard copper wire or another conductor. As shown in FIG. 2, the coil 26 is typically in front of the pressure sensor 24 on the barrel 12 so that, when the nail gun 10 abuts a target material, the coil 26 in particular also abuts or is in close proximity to the target material.

The coil 26 forms part of a sensor circuit 30 shown in FIGS. 1 and 3. The sensor circuit 30 disables the nail gun 10 from automatically discharging nails at times when the nail gun is misdirected toward human flesh such as a human hand 29 (see FIGS. 2 and 3) instead of toward a standard target material such as the wooden beam 25. Although the sensor circuit 30 disables the nail gun 10 from automatically discharging nails in such circumstances, in the embodiment of FIG. 1 the operator is able to override the disabling of the nail gun by manually pressing the trigger 16. Thus, if it is determined by the operator that the sensor circuit 30 has incorrectly determined a material proximate the tip 22 to be human flesh when it is not, the operator can override this determination.

In alternate embodiments, no manual override is possible, or another device other than the trigger 16 governs the overriding of the determination of the sensor to circuit 30. In further alternate embodiments, the nail gun 10 is not designed to allow automatic discharging of nails, but rather is designed to allow only manual triggering of the discharging of nails (e.g., there is no pressure sensor 24 and manual triggering occurs by way of the trigger 16). In such embodiments, the sensor circuit 30 would preclude any manual triggering of the discharging of nails whenever the sensor circuit determined that the nail gun 10 was misdirected toward human flesh.

Referring to FIG. 3, the sensor circuit 30 operates to distinguish human flesh such as the hand 29 from other materials such as the wooden beam 25 by sensing two characteristics using the coil 26, namely, resistance (or conductance) and reactance. The sensor circuit 30 shown in FIG. 3 is an exemplary embodiment of a sensor circuit that is capable of measuring both resistance and reactance; however, alternative embodiments are also possible.

As shown in FIG. 3, the effective circuit of the coil 26 in proximity to a material that is at least partly conductive, such as the wooden beam 25 or the human hand 29, can be modeled as the coil 26 having inductance L1, inductively coupled (as if in a transformer) to a second inductor 13 having inductance L2, which is connected in parallel with an imaginary element 15 and a resistor 17 having reactance J1 and resistance R1, respectively. The inductor 13, imaginary element 15, and resistor 17 are not discrete elements, but are merely respectively representative of the equivalent lumped values incorporating the distributed inductance, reactance and resistance of many looping current paths of eddy currents that can pass through either of the materials 25,29. The reactance of the imaginary element 15 can include both inductance and capacitance (+JX or −JX, respectively). Generally, however, the resistance R1 of the resistor 17 will reflect a total resistance (or conductance, 1/R1) in the region proximate the coil 26.

Figure 4:
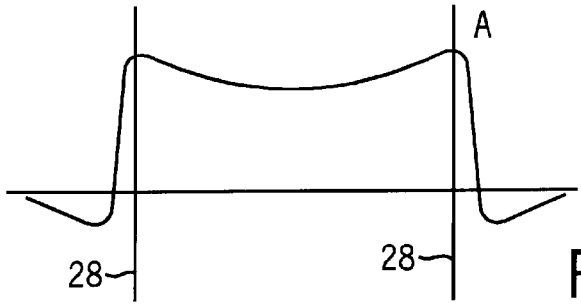
FIG. 4 is a plot of magnetic field strength versus distance through the target material of FIG. 2 along line 3—3 when the tip of the nail gun including the coil of FIGS. 1 and 2 abuts the target material.

When an oscillating current is provided to the coil 26, a changing magnetic field or flux 27 is produced by the coil. FIG. 4 shows an exemplary amplitude of the magnetic flux 27 along a transverse plane through a target material such as the wooden beam 25 caused by oscillatory current flow through the coil 26. As shown, the amplitude of the magnetic flux 27 is concentrated within the target material and drops off rapidly beyond the outer edges 28 of the target material.

Whenever a conductive or partially-conductive material such as materials 25,29 is proximate the coil 26, the oscillating magnetic flux 27 will induce eddy currents within the material. The magnitude of the eddy currents is proportional to the conductivity of the material. For example, if the material proximate the coil 26 was metal and was perfectly conductive, then theoretically the eddy currents would be sufficiently strong as to generate a magnetic flux (back EMF) opposing the magnetic flux 27 to completely cancel the magnetic flux 27 within the coil 26. To the extent that the material is not perfectly conductive, the eddy currents will be lower, and so the magnetic flux 27 will be reduced but not canceled. Thus, a measurement of the back EMF that is created in the coil 26 by the eddy currents within the material abutting the coil provides an indication of the conductivity and thus the resistance of that material.

The back EMF created in this coil 26 and thus the resistance R1 of the effective resistor 17 is detectable as a decrease in the quality factor of an resonant tank circuit 31 employing the coil 26. The resonant tank circuit 31 is formed from the parallel combination of the inductance L1 of the coil 26, and the capacitance C2 of a capacitor 33 within the sensor circuit 30. In a preferred embodiment, the capacitance value C2 is selected to tune the combination of L1 and C2 into parallel resonance at approximately 4.5 MHz.

As is known in the art, the quality factor of the resonant tank circuit 31 provides a measure generally indicating how long the resonant tank circuit would continue to oscillate without the input of additional energy (free oscillation). Without eddy currents, the resonant tank circuit 31 formed from the coil 26 and the capacitor 33 would be expected to oscillate for a time limited only by the intrinsic resistance associated with the coil and the capacitor. With eddy currents, the resulting back EMF adds an effective power dissipating resistance to the resonant tank circuit, shortening the time of free oscillation. Thus, a measure of the quality factor of the resonant tank circuit 31 provides an indication of the resistance (or conductance or conductivity) of whatever material is proximate the coil (such as materials 25 or 29).

Although the resistance of a material proximate the coil 26, such as materials 25 or 29, can be determined by measuring the quality factor of the resonant tank circuit 31, quality factor measurements do not provide an indication of the reactance of the material proximate the coil. However, because the resonant frequency of the resonant tank circuit 31 varies based upon the values of the effective reactance J1 (which can include inductance and/or capacitance) as well as the inductance L2 of either material 25 or 29, measurement of changes in the resonant frequency of the resonant tank circuit 31 can be used as an indication of the reactance of the material. Typically, if the reactance is positive (e.g., primarily due to the inductance), the resonant frequency will be increased above its normal level, while if the reactance is negative (e.g., primarily due to capacitance), the resonant frequency will be decreased below its normal level.

The sensor circuit 30 includes circuit elements that are capable of detecting (or detecting changes in) both the quality factor and the resonant frequency, which respectively are then used to determine the effective resistance R1 and the effective reactance (due to the effective inductance and/or capacitance) of a material proximate the coil 26 such as the materials 25 or 29. With respect to determining the resonant frequency of the resonant tank circuit 31 as affected by a material such as materials 25 or 29, the sensor circuit 30 includes a frequency detector 34 that is coupled to the resonant tank circuit and produces a frequency signal ($f_{OUT}$) indicative of the resonant frequency of the resonant tank circuit. The frequency detector 34 can be any one of a number of different types of frequency counters or detection circuits known to those skilled in the art.

As for determining the quality factor, measurement of the quality factor of a resonant circuit is well known in the art. To improve the accuracy of the quality factor measurement, the measurement should be made at the resonant frequency of the resonant tank circuit 31 as affected by any material proximate the coil 26 such as the materials 25 or 29. Therefore, in a preferred embodiment, an operational transconductance amplifier (OTA) 32 is employed as an oscillator to provide the desired feature of tracking the resonant frequency of the resonant tank circuit 31 as affected by the proximate material, and to drive the resonant tank circuit at that resonant frequency.

As shown in FIG. 3, the OTA 32 is connected at its output 38 to a first junction 37 between the capacitor 33 and the coil 26 of the resonant tank circuit 31, which is also the junction at which the frequency detector 34 is coupled. A remaining junction 39 between the capacitor 33 and the coil 26 is connected to ground. The output 38 of the OTA 32 is also connected to a non-inverting input 35 of the OTA 32. In this positive feedback configuration, the output current at the output 38 of the OTA 32 will naturally oscillate at the resonant frequency of the resonant tank circuit 31 as affected by a material proximate the coil 26 such as materials 25,29. Consequently, the output current at the output 38 is an oscillator signal 41 that drives the resonant tank circuit 31 at its resonant frequency (as affected by any proximate material such as materials 25, 29) so that the resonant tank circuit will continue to oscillate. It will be further understood that, by driving the resonant tank circuit 31 at its resonant frequency, undesired capacitive and inductive influences on the measurement are often reduced because some of the inductive components of the detected signal will cancel the capacitive components of that signal.

In addition to driving the oscillation of the resonant tank circuit 31 at its resonant frequency (as affected by any proximate material such as materials 25,29), the OTA 32 also precisely controls the amplitude of the oscillator signal 41 driving the resonant tank circuit to be at a constant value. In this way, the effect of amplitude on the quality factor measurement is eliminated and apparent changes in quality factors such as might be caused by a slight detuning of the oscillator signal 41 with respect to the resonant frequency of the resonant tank circuit 31 are reduced.

In order for the OTA 32 to control the amplitude of the oscillator signal 41, the OTA operates in conjunction with additional circuit elements that provide the OTA with an amplifier bias current $I_{abc}$ based upon the oscillator signal 41 at the output 38 of the OTA. As is understood in the art, the output current (e.g., the oscillator signal 41) of an operational transconductance amplifier such as the OTA 32 can be modeled as a gain factor $G_m$ times the voltage across an inverting input 36 and the non-inverting input 35 (indicated by a minus and plus sign, respectively) of the operational transconductance amplifier. The value $G_m$ is determined by the amplifier bias current $I_{abc}$.

In the present embodiment, the amplifier bias current $I_{abc}$ is determined as follows. The oscillator signal 41 on the output 38 of OTA 32 is received by an amplitude detector 40, which includes a precision synchronous rectifier 45 coupled in series with a low-pass filter 46. The amplitude detector 40 provides at its output 47 a DC voltage proportional to the amplitude of the oscillator signal 41 at the output 38. The synchronous rectifier 45 is realized in the preferred embodiment by a multiplier that accepts at both of its two factor inputs the output 38. Any noise signal on the output 38 that is a synchronous with the oscillator signal 41 will average to zero in the low pass filter 46. The DC voltage provided at the output 47 of the amplitude detector 40 is received by an inverting input of a standard high-gain operational amplifier 42, the non-inverting input of which is provided with a precision reference voltage 44 designated as $V_r$.

The amplifier 42 operates open-loop, and hence it will be understood that if the voltage on the inverting input of the amplifier 42 is greater than $V_r$, the output of the amplifier 42 will be a negative value. On the other hand, if the voltage on the inverting input of the amplifier 42 is negative with respect to $V_r$, the output of amplifier 42 will be positive. The output of the amplifier 42, termed $V_{OUT}$, is applied to a limiting resistor 43 to become the amplifier bias current $I_{abc}$.

The connection of the output of the amplifier 42 $V_{OUT}$ to the OTA 32 provides feedback control of the amplitude of the oscillator signal 41 to the value of $V_r$. As connected in this manner, the value of $V_{OUT}$ further is an amplitude error signal indicative of the quality factor of the resonant circuit 31 as affected by any material proximate the coil 26 such as materials 25 or 29. This is because $V_{OUT}$ generally indicates how much additional energy must be input into the resonant tank circuit 31 to maintain oscillation at the desired amplitude of $V_r$, which is a measure of the quality factor of the resonant tank circuit.

Using $V_{OUT}$ and $f_{OUT}$ respectively as indications of the quality factor and resonant frequency of the resonant tank circuit 31 as affected by any material proximate the coil 26 such as materials 25 or 29, the sensor circuit 30 is able to determine the effective resistance and reactance of the proximate material and additionally determine whether the material is likely to be human flesh as opposed to some other material. Specifically, the signals $V_{OUT}$ and $f_{OUT}$ are provided to a processor 50. The processor 50 converts the values of $V_{OUT}$ and $f_{OUT}$ respectively into corresponding resistance and reactance values using known relationships. The resistance and reactance values are then compared with resistance and reactance values that are known to be approximately those corresponding to human flesh.

If the values are indeed approximately those corresponding to human flesh, the processor 50 produces a flesh detection signal 52. The flesh detection signal 52 can, as discussed above, be used to prevent automatic (or, depending upon the embodiment, manual) discharging of nails by the nail gun 10. Also, in certain embodiments, the flesh detection signal 52 governs the switching on of a lamp 55 (or other indicator) on the nail gun 10 indicating that the material proximate the tip 22 of the nail gun is human flesh (see FIG. 1). In alternate embodiments, the flesh detection signal 52 is continuously provided from the processor 50, but the value of the flesh detection signal varies depending upon the resistance and reactance values that are determined.

A variety of specific embodiments of the processor 50 are possible. For example, in one embodiment, the processor 50 includes one or more comparators that compare the values of resistance and reactance based on $V_{OUT}$ and $f_{OUT}$ with known threshold values that are indicative of human flesh. In another embodiment, the processor 50 includes, in a memory, an array or other representation of a graph 60 of resistance (R) versus reactance (+/−JX) such as that shown in FIG. 5. Certain regions of the graph 60 are understood to correspond to target materials such as metal or wood (e.g., regions 62 and 64, respectively), while other regions of the graph such as region 66 are understood to correspond to human flesh. The values of resistance and reactance shown in FIG. 5 as being indicative of metal, wood, and flesh are merely intended to be exemplary, and actual values may vary from the values shown.

Depending upon the embodiment, the processor 50 is capable of converting values of $V_{OUT}$ and $f_{OUT}$ into corresponding values of resistance and reactance in a variety of ways. In one embodiment, the processor 50 includes look-up tables representing levels of resistance corresponding to particular values of $V_{OUT}$, and levels of reactance corresponding to particular values of $f_{OUT}$ The processor 50 is capable of interpolating in between discrete values of the look-up tables. In alternate embodiments, the processor 50 converts values of $V_{OUT}$ and $f_{OUT}$ into resistance and reactance values by way of formulas. In additional alternate embodiments, no conversion is made; rather, the received values of $V_{OUT}$ and $f_{OUT}$ are directly compared with values of $V_{OUT}$ and $f_{OUT}$ that are known to correspond to human flesh. Generally, the processor 50 can be any device that is able to detect human flesh based upon the input values of $V_{OUT}$ and $f_{OUT}$ The exact correspondences between $V_{OUT}$ and resistance, and $f_{OUT}$ and reactance, as well as the particular levels of resistance and reactance that are indicative of human flesh, will depend upon the particular embodiment of the nail gun 10, sensor circuit 30 and coil 26. However, each of these relationships and values can be either calculated or experimentally determined by one skilled in the art.

Many other modifications and variations of the preferred embodiment which will still be within the spirit and scope of the invention will be apparent to those with ordinary skill in the art. In order to apprise the public of the various embodiments that may fall within the scope of the invention, the following claims are made.

I claim:

1. A device for discharging fastening elements comprising:

a body having a location at which the fastening elements are discharged; and a sensor circuit supported by the body, the sensor circuit including a conductive coil proximate the location and further including:

a capacitive element connected in parallel with the conductive coil so that the capacitive element and the conductive coil form a resonant tank circuit;

a frequency detector connected to the resonant tank circuit, the frequency detector detecting a frequency of oscillation of the resonant tank circuit as affected by a material proximate the conductive coil and outputting a frequency signal indicative thereof;

an oscillator having an output terminal and a control terminal, wherein the output terminal is connected to the resonant tank circuit, wherein the oscillator drives the resonant tank circuit at the resonant frequency of the resonant tank circuit as affected by the material proximate the conductive coil;

an amplitude control circuit coupled to the oscillator, the amplitude control circuit receiving an electrical signal from the output terminal and in response generating a control signal that is provided to the control terminal of the oscillator; and a processor that receives the frequency signal and an additional signal that is functionally related to the control signal, wherein the processor provides an output signal that prevents the device from discharging at least one of the fastening elements when the processor determines that the frequency signal and the additional signal indicate that the material proximate the conductive coil is a particular material into which the fasteners should not be discharged.

2. The device of claim 1, wherein the device is a nail gun and the fastening devices are nails.

3. The device of claim 2, wherein the location is a tip of a barrel of the nail gun.

4. The device of claim 1, wherein the oscillator is an operational transconductance amplifier.

5. The device of claim 4, wherein a first input terminal of the oscillator is also connected to the resonant tank circuit, and wherein a second input terminal of the oscillator is connected to ground.

6. The device of claim 5, wherein the oscillator operates in a positive feedback mode with respect to the resonant tank circuit such that the electrical signal tracks the resonant frequency of the resonant tank circuit as affected by the material.

7. The device of claim 1, wherein the amplitude control circuit includes a rectifier that receives the electrical signal and produces a rectified signal, a low pass filter that receives the rectified signal and produces a filtered signal, and an operational amplifier that receives the filtered signal at a first input terminal and produces an additional output signal in response thereto, wherein the control signal is based upon the additional output signal.

8. The device of claim 7, wherein a voltage source is coupled between ground and a second input terminal of the operational amplifier, and wherein the additional output signal from the operational amplifier is the additional signal.

9. The device of claim 7, wherein the additional output signal is a voltage signal that is indicative of a quality factor of the resonant tank circuit as affected by the material.

10. The device of claim 7, wherein the rectifier multiplies the electrical signal by itself to obtain the rectified signal.

11. The device of claim 1, wherein the processor determines a resistance of the material based upon the additional output signal using at least one of a formula and a look-up table, and wherein the processor determines a reactance of the material based upon the frequency signal using at least one of a second formula and a second look-up table.

12. The device of claim 1, wherein the processor includes a memory device in which are stored at least one of: values of resistances and reactances corresponding to the particular material; and values of the additional output signal and the frequency signal corresponding to the particular material.

13. The device of claim 1, wherein the processor continually produces the output signal, and the output signal varies depending upon the material that is proximate the coil.

14. The device of claim 1, further comprising a trigger and a pressure sensor adjacent to the coil wherein, when the processor is not producing the output signal to prevent the discharging of the fastening elements, the device discharges fastening devices in response to both signals from the trigger and signals from the pressure sensor; and, when the processor is producing the output signal to prevent the discharging of the fastening elements, the device discharges fastening devices in response to only signals from the trigger.

15. The device of claim 1, wherein the device is a stapler.

16. The device of claim 1, wherein the particular material is human flesh.

17. A tool for discharging fastening devices comprising:

means for discharging the fastening devices;

means for determining when the fastening devices are to be discharged, wherein the determining means is coupled to the discharging means;

means for generating an oscillatory signal, wherein a resonant frequency of the oscillatory signal depends both upon characteristics of the generating means and also upon a material proximate at least one portion of the generating means, and wherein the generating means is supported by the discharging means;

means for detecting a frequency of the oscillatory signal and producing a first signal indicative thereof, wherein the detecting means is electrically coupled to the generating means;

means for producing a second signal indicative of a quality factor of the oscillatory signal, wherein the quality factor depends at least in part upon the material proximate the at least one portion of the generating means, and wherein the producing means is coupled to the generating means; and means for providing a third signal to prevent the determining means from causing the discharging means to discharge at least one of the fastening devices, wherein the third signal is provided in response to the first and second signals.

18. The tool of claim 17, wherein the tool is a nail gun; wherein the determining means includes a pressure sensor proximate a tip of a barrel of the nail gun; wherein the generating means includes a resonant tank circuit and an oscillator coupled to the resonant tank circuit; wherein the producing means includes an amplitude control circuit; and wherein the providing means is a processor.

19. A method of preventing a tool from discharging a fastening device into human flesh, the method comprising:

exciting a resonant tank circuit having a coil with an electrical signal to produce an oscillatory signal within the resonant tank circuit and an electromagnetic field that envelops a material that is proximate the coil, wherein the electrical signal is continually adjusted to be at a resonant frequency of the resonant tank circuit as affected by the material;

generating a frequency signal indicative of a frequency of oscillation of the oscillatory signal, which is the resonant frequency of the resonant tank circuit as affected by the material;

generating a control signal for controlling an amplitude of the electrical signal so that the oscillatory signal tends toward a constant amplitude;

processing the frequency signal and an additional signal that is functionally related to the control signal to determine whether the material has a resistance and a reactance characteristic of human flesh; and when the processing of the frequency signal and the additional signal indicates that the material has the resistance and the reactance characteristic of human flesh, producing an output signal that causes the tool to become disabled from discharging the fastening device.

20. The method of claim 19, wherein an oscillator provides the electrical signal to excite the resonant tank circuit, and an amplitude control circuit generates the control signal based upon the electrical signal, and wherein the additional signal is functionally related to the control signal by way of a resistance of a resistor.

* * * * *

UNITED STATES PATENT AND TRADEMARK OFFICE

CERTIFICATE OF CORRECTION

PATENT NO. : 6,471,106 B1
DATED : October 29, 2002
INVENTOR(S) : William N. Reining It is certified that error appears in the above-identified patent and that said Letters Patent is hereby corrected as shown below:

Column 4,
Line 27, delete “to” from “sensor to circuit”.

Column 7,
Line 9, “a synchronous” should be -- asynchronous --.

Signed and Sealed this

Twentieth Day of May, 2003

JAMES E. ROGAN
*Director of the United States Patent and Trademark Office*